US007703214B2

(12) United States Patent
Platt

(10) Patent No.: US 7,703,214 B2
(45) Date of Patent: Apr. 27, 2010

(54) RULER FOR MULTIPLE PICOTS

(76) Inventor: Janet R. Platt, 5211 Hampton Ct., Highland, UT (US) 84003

( * ) Notice: Subject to any disclaimer, the term of this patent is extended or adjusted under 35 U.S.C. 154(b) by 195 days.

(21) Appl. No.: 11/863,891

(22) Filed: Sep. 28, 2007

(65) Prior Publication Data

US 2009/0083984 A1 Apr. 2, 2009

(51) Int. Cl.
*A41H 1/00* (2006.01)
*B43L 7/00* (2006.01)

(52) U.S. Cl. ..... 33/492; 33/11; 33/563

(58) Field of Classification Search ..... 33/1 F, 33/1 G, 2 R, 11, 12, 13, 483, 492, 494, 500, 33/562, 563, 565, 566; D10/64
See application file for complete search history.

(56) References Cited

U.S. PATENT DOCUMENTS

| | | | | | |
|---|---|---|---|---|---|
| D28,398 | S | * | 3/1898 | Emley | D10/64 |
| 861,799 | A | * | 7/1907 | Breil | 33/494 |
| 2,245,313 | A | * | 6/1941 | Wilhite | 33/11 |
| 2,579,664 | A | * | 12/1951 | Gleasman | 33/492 |
| 2,977,684 | A | * | 4/1961 | Campanile | 33/2 R |
| 3,071,171 | A | * | 1/1963 | Guerrero | 33/524 |
| 3,257,727 | A | * | 6/1966 | Erna | 33/12 |
| 3,279,075 | A | * | 10/1966 | Mello | 33/474 |
| 4,408,397 | A | * | 10/1983 | Bartos | 33/524 |
| 4,565,012 | A | * | 1/1986 | Bilodeau et al. | 33/458 |
| D311,873 | S | | 11/1990 | Arend | |
| 5,094,006 | A | * | 3/1992 | Varney | 33/563 |
| 5,319,859 | A | * | 6/1994 | Smith | 33/563 |
| 5,487,223 | A | * | 1/1996 | Krane | 33/494 |
| 5,557,996 | A | | 9/1996 | Reber et al. | |
| 5,638,605 | A | | 6/1997 | Sligar | |
| 5,829,150 | A | | 11/1998 | McEligot | |
| 6,108,918 | A | | 8/2000 | Ye | |
| 6,276,070 | B1 | | 8/2001 | Hawley | |
| 6,321,458 | B1 | | 11/2001 | Hess | |
| 6,925,724 | B2 | | 8/2005 | Tandy | |
| 6,935,039 | B1 | | 8/2005 | Hess | |
| 6,944,963 | B2 | | 9/2005 | Amaru | |
| 7,185,441 | B2 | | 3/2007 | Lockyer | |
| 2004/0143979 | A1 | | 7/2004 | Albright et al. | |
| 2005/0252019 | A1 | | 11/2005 | Gordon et al. | |
| 2007/0193051 | A1 | | 8/2007 | Winslow | |

OTHER PUBLICATIONS http://www.quiltersbee.com/Prairie.htm.
http://www.freespiritquiltguild.com/Reference%20articles/ContinuousPrairiePoints.pdf.

* cited by examiner

*Primary Examiner*—R. A. Smith
(74) *Attorney, Agent, or Firm*—F. Chad Copier

(57) ABSTRACT

Rulers and templates that are used to create several connected picots (or prairie points) made from a single piece of material, as well as methods for making and using such rulers, are described in this application. The rulers described in this application have a plurality of evenly spaced, alternating slots formed or cut in opposite, parallel edges of a substrate, resulting in evenly spaced, alternating tabs located on the opposite, parallel edges of the substrate. The ruler may be used to cut or mark material into connected squares that may be folded to make picots. The resulting picots are of uniform size and spacing, and are connected as a unitary piece of material.

20 Claims, 4 Drawing Sheets

RULER FOR MULTIPLE PICOTS

FIELD

This application relates generally to rulers and methods of making and using such rulers. In particular, this application relates to rulers that are used to create continuous picots, sometimes called prairie points, as wells as methods for making and using such rulers.

BACKGROUND

Often, making quilts can involve tedious tasks such as cutting multiple pieces of fabric to be used in a quilt. Many times, these multiple pieces of fabric must be equal sizes to create patterns in the quilt. One such pattern involves making picot or prairie points, which are often used in borders. Picot borders are overlapping triangles on the edges of sewn items such as quilts, baby blankets, clothing, etc. Picots are usually evenly spaced along an edge of a quilt or blanket such that the edge has a saw-tooth effect.

As shown in FIGS. 1A-1D, to make traditional picots 10, the edge 22 of the project 20 to be covered with picots 10 is measured and the number of picots 10 needed is determined based on the amount of overlap of the picots desired, the desired size of picots, and the linear measurement of the edges 22 to be decorated with picots. One square 10 is then cut out of fabric for each picot 10 needed. Each of the squares must be the same size and be square, such that all four sides have the same measurement. Measuring, marking, and cutting each picot square 10 using a traditional ruler, marking tool and cutter, such as a rotary cutter or scissors, is time consuming and difficult due to the repetition and precision required.

Each square 10 is then folded in half to create a triangle (FIG. 1A), and then folded in half again to form a smaller triangle (FIG. 1B). After folding, each of the cut edges of the fabric square are together on one edge of the triangle. The triangle 10 is then stitched 12 or glued at the cut edges to hold the triangle 10 in place, making a picot 10. Alternatively, the picot 10 may be pinned or taped to hold the triangular shape.

The steps are repeated for each of the needed picots 10 in the project 20. The picots 10 are then lined up along the edge 22 of the project 20 to be decorated with picots 10 and sewn into place (FIG. 1D). Precise placement of the picots 10 is necessary to achieve an evenly spaced and aligned picot border. Each step in creating a picot border is time consuming and requires precision to ensure a desirable outcome. Because of the time consuming nature and requirement of a highly skilled person to create the picot border, quilts, blankets, and other projects with picot borders are highly desirable. Similarly, people desiring to make a project with a picot border do not undertake the project lightly due to the time and skill required.

SUMMARY

Rulers and templates that are used to create several connected picots (or prairie points) made from a single piece of material, as well as methods for making and using such rulers, are described in this application. The rulers described in this application have a plurality of evenly spaced, alternating slots formed or cut in opposite, parallel edges of a substrate, resulting in evenly spaced, alternating tabs located on the opposite, parallel edges of the substrate. The ruler may be used to cut or mark material into connected squares that may be folded to make picots. The resulting picots are of uniform size and spacing, and are connected as a monolithic piece of material.

BRIEF DESCRIPTION OF THE DRAWINGS

The following description can be better understood in light of Figures, in which.

Figure 1A:
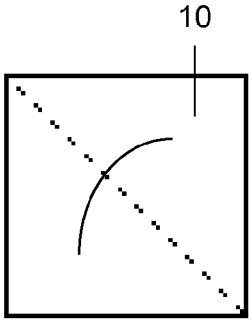
Fig. 1A (Prior Art)
FIG. 1A-1D illustrate an example of picots and a method of making picots.
Figure 1B:
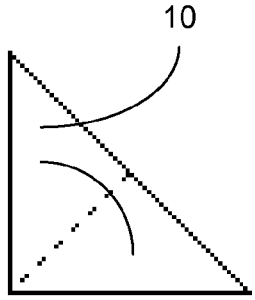
Fig. 1B (Prior Art)
Figure 1C:
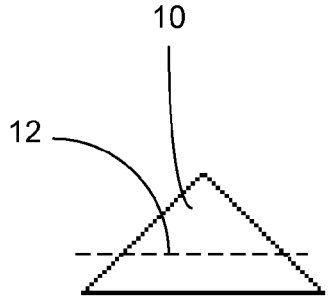
Fig. 1C (Prior Art)
Figure 1D:
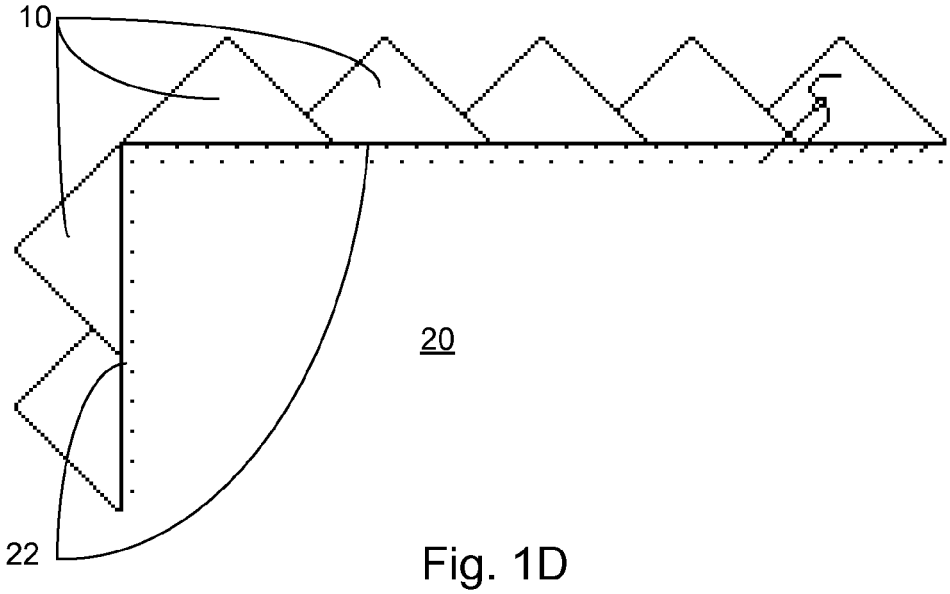
Fig. 1D (Prior Art)

Together with the following description, the Figures demonstrate and explain the principles of the apparatus and methods for using the ruler for making picots. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on picots for use in quilting, the apparatus and associated methods could be equally applied in other processes and fields, such as scrapbooking, greeting card making, and other creative arts.

Figure 2:
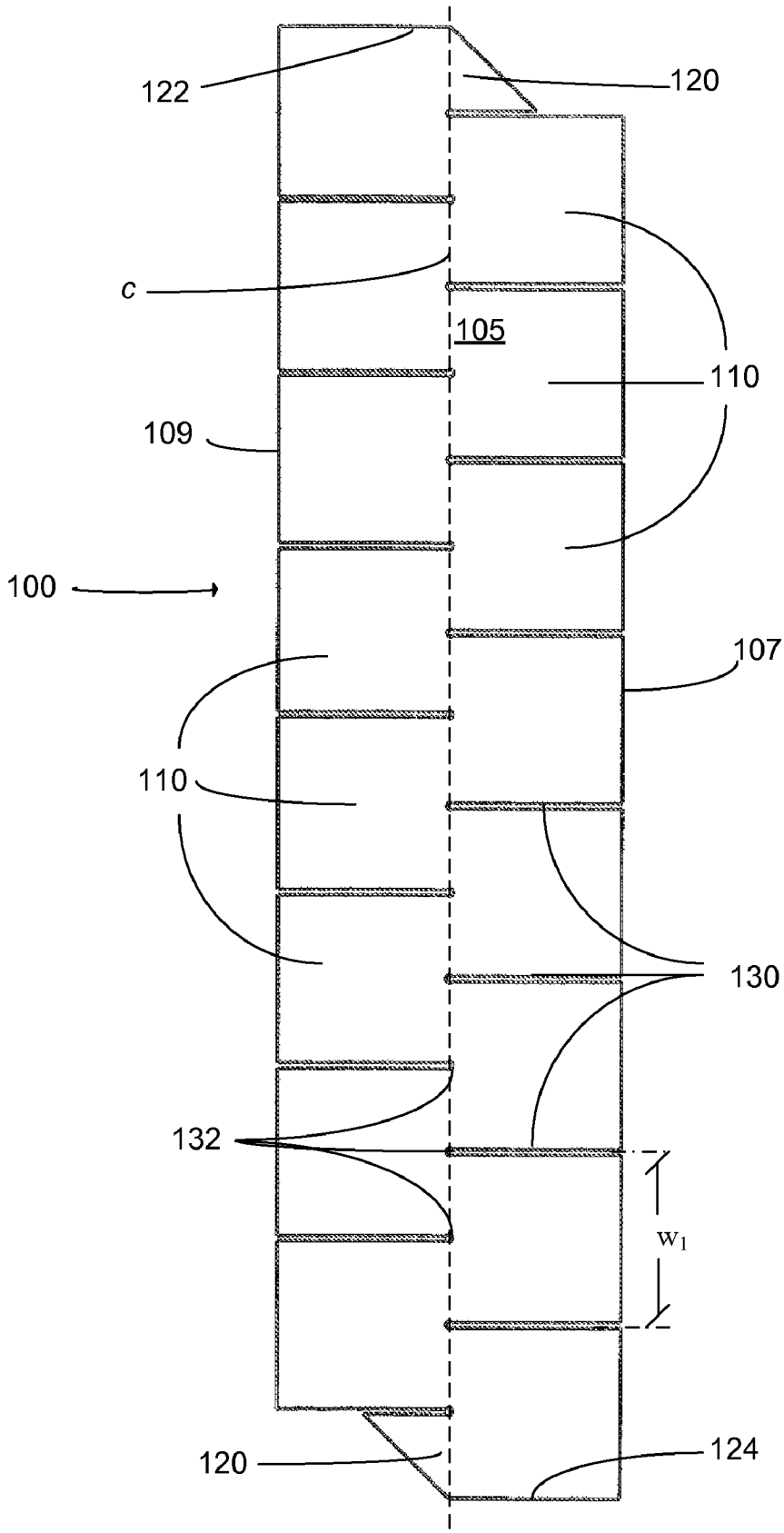
FIG. 2 illustrates an exemplary device for making picots.
Figure 3:
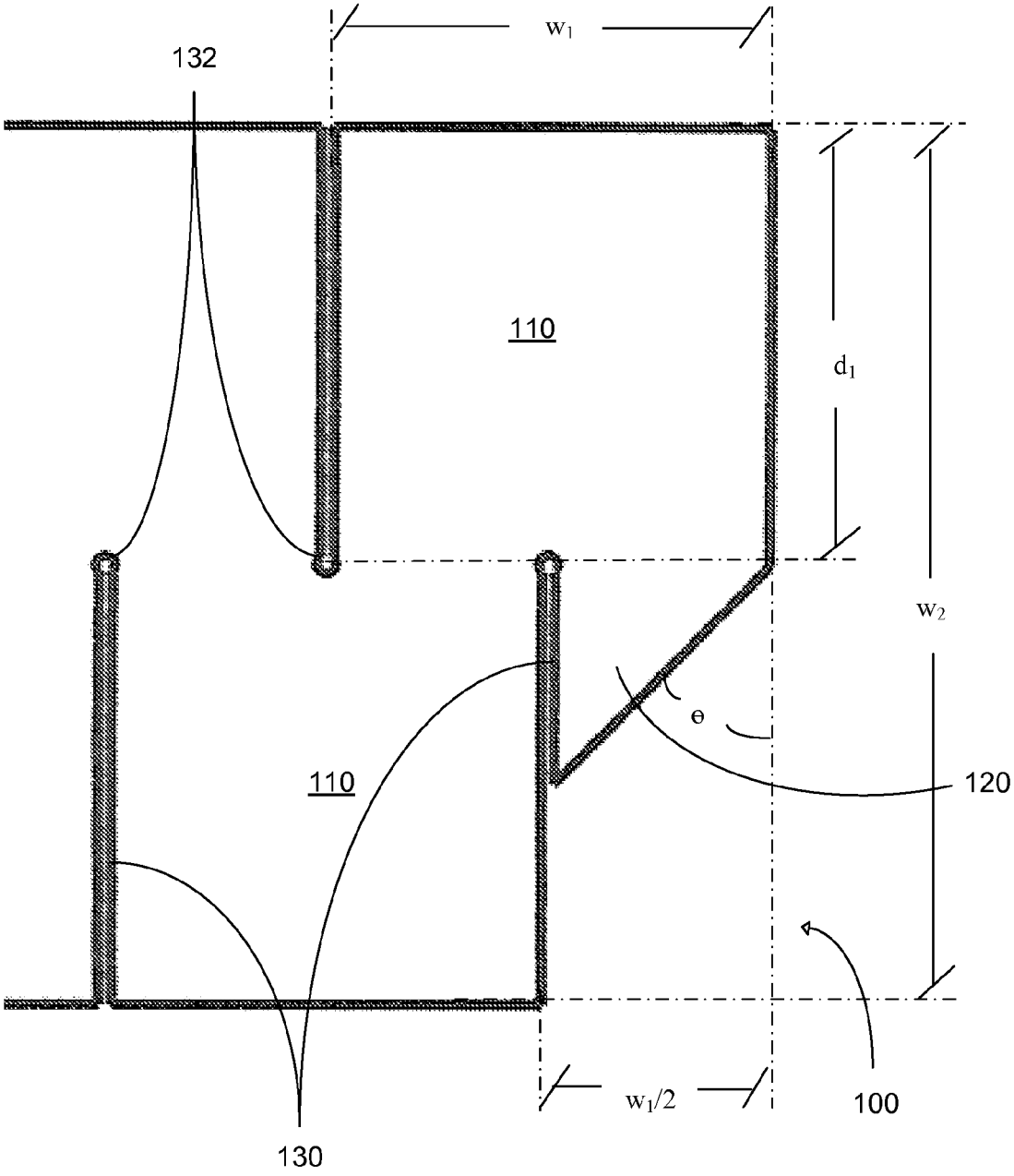
FIG. 3 illustrates a portion of the device illustrated in FIG. 2.
Figure 4:
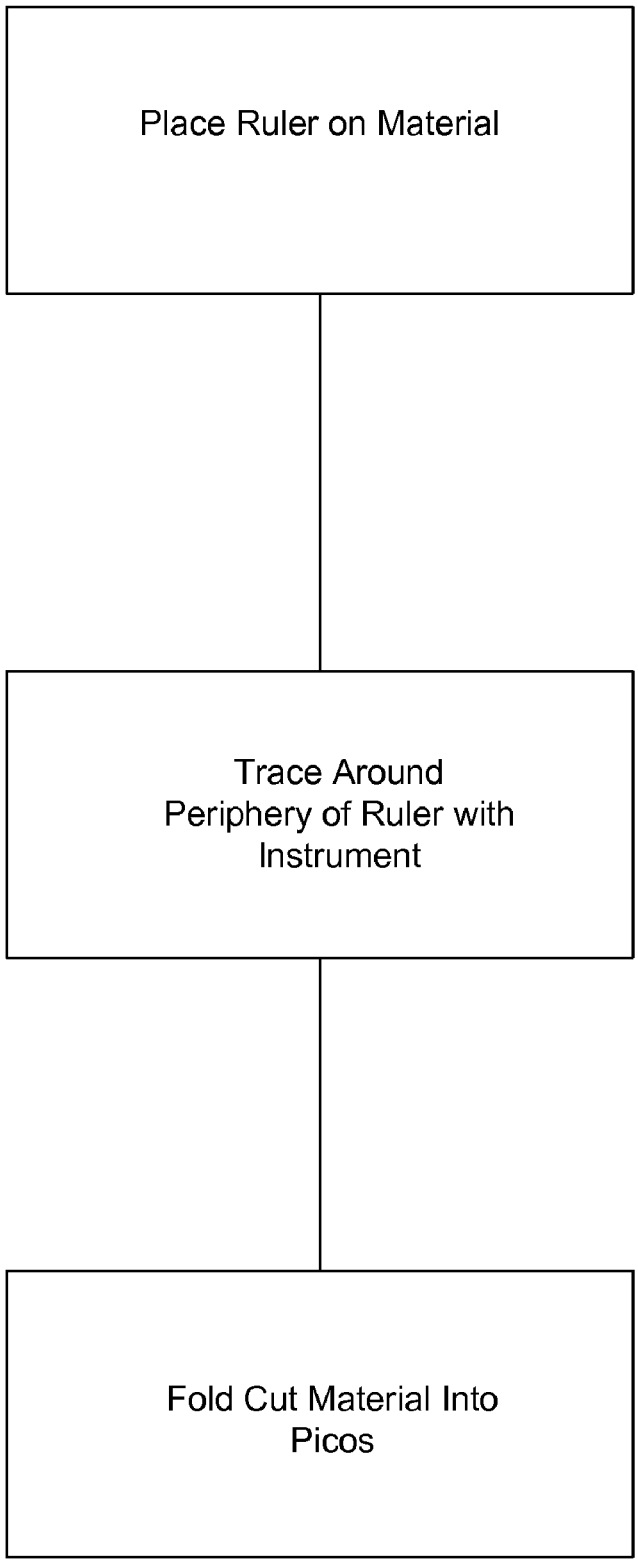
FIG. 4 is a flowchart of a method of using an exemplary device for making picots.

The ruler for making a plurality of adjoined picots (hereinafter, "ruler") described in this application may have any configuration consistent with the picot detail described below. One exemplary configuration of a ruler is illustrated in FIGS. 2 and 3. In FIG. 2, ruler 100 includes a substrate 105 having two opposing parallel edges 107, 109. Ruler 100 may also include slots 130 formed in substrate 105. Slots 130 may be evenly spaced such that a plurality of tabs 110 may be created adjacent to edges 107, 109. Slots 130 may be alternating between edges 107, 109 such that each of slots 130 is faced by a tab 110 on the opposite side of substrate 105.

Slots 130 may be dimensioned such that depth $d_1$ of each of slots 130 extending from edge 107, 109 to slot end 132 is about the same as width $w_1$ of tabs 110. Slots 130 may be allow sufficient space for an instrument to move along slot 130 and contact a surface or material placed under ruler 100. For example, slot 130 may be about 2 mm wide, allowing a rotary cutter to cut a piece of fabric placed under ruler 100. Similarly, slot 130 may have sufficient width to allow a stylus to mark paper, or a writing instrument to mark on a material under ruler 100. For example, slot 130 may be between about 1 mm and 1 cm wide, depending on the size and configuration of the desired instrument.

Slot ends 132 may be rounded such that slot end 132 may be wider than slot 130. In some embodiments, slot end 132 may be the same width as slot 130. In other embodiments, slot end 132 may be about 4 times the width of slot 130. Slot end 132 may form a semi-circle, or may form a tear-drop shape.

Width $w_2$ of ruler 100 may be at least about two times width $w_1$ of tabs 110. Thus, in some embodiments, each of slot ends 132 may be located at about a centerline c of ruler 100. In other embodiments, slot ends 132 may be offset from a centerline c of ruler 100, providing a center strip extending from edge 122 to edge 124 in ruler 100 free of slots 130.

Ends 122, 124 of ruler 100 may include angled tab 120 at angle θ from end 122, 124, beginning at about the depth of slot 130 in substrate 105 and extending into substrate 105 until contacting adjacent slot 130. Angle θ may be about 45 degrees. In some embodiments, angle θ may be any angle from 0 to 90 degrees. Angled tab 120 may be half of width $w_1$, such that the width of angled tab 120 may be $w_1/2$, as illustrated in FIG. 3. For example, with θ at 45 degrees, angled tab 120 is about half as long at its longest point as tabs 110.

Width $w_1$ may be selected depending on the desired size of the picots to be made using ruler 100. Width $w_1$ may be any length desired by one of skill. For example, a quilt pattern may require picots from 4 inch square pieces of fabric. In this example, $w_1$ would be 4 inches. In another example, $w_1$ may be about 0.5 inches for creating a border for a picture in a scrapbook. In another example, $w_1$ may be about 24 inches for creating a picot border on a large flag. Other larger and smaller dimensions may be required for various projects and are included in this disclosure.

Similarly, ruler 100 may be of any length with any number of tabs 100, depending on the number of picots desired and on the comfort of the person using ruler 100. Some embodiments may have as few as two tabs 110, while other embodiments may have 50 or more tabs 110.

Ruler 100 may be made from any material suitable for a template or ruler. For example, ruler 100 may be made of metals, plastics (such as acrylics, polycarbonate, PVC, resins, etc.), composite materials (such as fiberglass), paper, etc. In some embodiments, ruler 100 may include a durable top layer, resistant to cutting, and a soft lower layer for contacting and holding material to be cut in place. For example, ruler 100 made of metal may include a cork backing to help prevent ruler 100 from sliding on polyester fabric to be cut into picots. Similarly, neoprene, rubber, plastics, or other material may be used as a bottom layer.

To use ruler 100, a person places ruler 100 on a material to be cut into picots. The person then uses an instrument to trace along the edges, including slots 130, of ruler 100. The instrument may be a razor blade, a rotary cutter, scissors, stylus, pencil, pen, penknife, marking pencil, chalk, etc. A duplicate of the pattern on ruler 100 is then created in the material to be cut. Depending on the instrument used, the material may be cut, or may still require cutting. In some embodiments, multiple layers may be cut simultaneously.

The resulting cut material is then folded into a line of picots. In some embodiments, the cut material is folded in half such that the edges of the cut material corresponding to edges 107, 109 are touching. The cut material may then be creased or ironed to establish a centerline in the cut material for folding the picots. Starting at one end, a person may fold over the material corresponding to angled tab 122. The person then folds the material corresponding to tab 110 opposite angled tab 122 in a manner similar to the folding method described in reference to FIGS. 1A-1D, except that each square to be folded into a picot is connected at one end to the material. Each alternating picot is folded up onto the previous picots to form a line of picots that are connected as a unitary piece of material. The line of picots may then be attached together or attached to another piece of material to maintain the shape and line of picots. In some embodiments, adjacent picots may be folded such that each picot is in front of one adjacent picot and behind the other adjacent picot. In other embodiments, adjacent picots may be folded such that every other picot is in front of the adjacent picots.

In some embodiments, the material used to make the picots may be two or more materials joined such that the resulting picots vary in material. For example, to make a picot border for a quilt with alternating fabrics in the picots, two fabrics may be sewn together, and ruler 100 placed on the joined fabrics such that edge 107 is over one fabric and edge 109 is over the other fabric. As the picots are folded, they result in alternating picots.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A device for making picots, comprising:

a substrate; and a plurality of cuts in the substrate, wherein the plurality of cuts are evenly spaced in opposite edges of the substrate such that each cut of the plurality of cuts lies between adjacent cuts on the opposite edge or between a cut in the opposite edge adjacent to an end of the substrate and the end of the substrate, wherein each of the plurality of cuts in the substrate are complementary to each other and wherein the plurality of cuts in the substrate are configured to form multiple connected picots.

2. The device of claim 1, wherein the plurality of cuts extend towards a centerline of the substrate, and wherein the plurality of cuts extend at least one third of the distance between the edge of the substrate to the centerline.

3. The device of claim 1, further comprising at least one angled cut on an end edge of the substrate.

4. The device of claim 3, wherein the angled cut is cut at an angle of 45 degrees from the end edge.

5. The device of claim 1, wherein the plurality of cuts creates a plurality of tabs along the opposite edges of the substrate.

6. The device of claim 5, wherein each the plurality of tabs have the same width along the opposite edges of the substrate except an end tab on each of the opposite edges.

7. The device of claim 6, wherein the end tab has a width half as wide as the plurality of tabs.

8. The device of claim 6, wherein the width of each of the plurality of tabs is between 0.25 and 12 inches.

9. The device of claim 5, wherein the plurality of tabs are square, such that the plurality of cuts extend into the substrate a distance equal to the width of each of the plurality of tabs along the opposite edges of the substrate.

10. The device of claim 1, wherein the distance between the opposite edges of the substrate is greater than twice the distance between two adjacent cuts of the plurality of cuts along one of the opposite edges of the substrate.

11. The device of claim 1, wherein the substrate is made of one of metal, acrylic, and polycarbonate.

12. The device of claim 1, wherein each of the plurality of cuts include an expanded portion at the end of each of the cuts in the substrate.

13. The device of claim 1, wherein each of the plurality of cuts is configured to allow a cutting instrument to extend through the substrate and cut at least one layer of material under the device.

14. The device of claim 1, wherein the device is configured to be used as a pattern for cutting a plurality of picots in a connected chain.

15. A method of making a plurality of connected picots, comprising;

placing a pattern over a piece of material;

moving an instrument along each of the external edges of the pattern to create a replica of the pattern from the piece of material; and folding portions of the replica to form a plurality of picots.

16. The method of claim 15, wherein the instrument is a rotary cutter.

17. The method of claim 15, wherein the material is one of fabric and paper.

18. The method of claim 15, wherein the instrument is a marking instrument.

19. The method of claim 15, wherein the pattern is made of rigid materials, and wherein the pattern is reusable.

20. The method of claim 15, wherein the pattern includes a plurality of tabs arranged evenly and alternating on opposite edges of the pattern.

* * * * *